US008624568B2

(12) United States Patent
Ivanov et al.

(10) Patent No.: US 8,624,568 B2
(45) Date of Patent: Jan. 7, 2014

(54) LOW NOISE VOLTAGE REGULATOR AND METHOD WITH FAST SETTLING AND LOW-POWER CONSUMPTION

(75) Inventors: Vadim V. Ivanov, Tucson, AZ (US); Harish Venkataraman, Wylie, TX (US)

(73) Assignee: Texas Instruments Incorporated, Dallas, TX (US)

( * ) Notice: Subject to any disclaimer, the term of this patent is extended or adjusted under 35 U.S.C. 154(b) by 152 days.

(21) Appl. No.: 13/200,761

(22) Filed: Sep. 30, 2011

(65) Prior Publication Data

US 2013/0082671 A1 Apr. 4, 2013

(51) Int. Cl.
*G05F 1/00* (2006.01)

(52) U.S. Cl.
USPC ..... 323/274; 323/281

(58) Field of Classification Search
USPC ..... 323/273, 274, 275, 279, 280, 281, 311, 323/312, 313, 314; 330/255, 259, 260, 261, 330/262
See application file for complete search history.

(56) References Cited

U.S. PATENT DOCUMENTS

| | | | | |
|---|---|---|---|---|
| 6,188,211 | B1 * | 2/2001 | Rincon-Mora et al. | 323/280 |
| 6,930,551 | B2 | 8/2005 | Ivanov et al. | 330/264 |
| 7,633,280 | B2 | 12/2009 | Ivanov et al. | 323/326 |
| 7,741,823 | B2 * | 6/2010 | Terry et al. | 323/273 |
| 2009/0179622 | A1 * | 7/2009 | Ivanov et al. | 323/271 |
| 2009/0322429 | A1 * | 12/2009 | Ivanov et al. | 330/257 |

* cited by examiner

*Primary Examiner* — Nguyen Tran
(74) *Attorney, Agent, or Firm* — Alan A. R. Cooper; W. James Brady, III; Frederick J. Telecky, Jr.

(57) ABSTRACT

A voltage regulator controls a regulated output voltage (Vout) by feeding it back to a differential input stage (13) receiving a reference voltage (Vref) and applying an output (3) to a control electrode of a follower transistor (M4) that is coupled to an output stage (15) which generates the output voltage (Vout). The output stage operates pull-up (M7B) and pull-down (M5B) transistors in response to a signal (6A) produced by the follower transistor (M4) during normal regulation operation, and provides fast settling of the output voltage by turning on a transient pull-up transistor (M7A) or transient pull-down transistor (M5A) in response to the signal (6A) produced by the follower transistor (M4) during a fast increasing or decreasing transition, respectively, of the load current ($I_L$). A filtering resistor ($R_{FLT}$) is coupled between the output voltage and a common electrode of the transient pull-up and pull down transistors.

18 Claims, 2 Drawing Sheets

LOW NOISE VOLTAGE REGULATOR AND METHOD WITH FAST SETTLING AND LOW-POWER CONSUMPTION

BACKGROUND OF THE INVENTION

The present invention relates generally to low-dropout voltage regulators (LDO voltage regulators), and more particularly to improvements which provide low noise at medium and high frequencies, fast settling of the regulated output voltage, and low power consumption.

Current consumption (and hence power consumption) of various digital logic circuits and especially other integrated circuits such as analog front end circuits, that are manufactured using various modern integrated circuit manufacturing processes can instantly, i.e., within a few picoseconds to a few nanoseconds, vary between zero and a large maximum value, e.g. 5 to 150 milliamperes. At the same time, very precise regulation is required for the supply voltages provided by voltage regulators to such digital logic circuits and other integrated circuitry such as analog front end circuits. Very low levels of noise at the signal frequency are required in the regulated supply voltages for some applications (e.g. radios and capacitive sensors), because such noise may become mixed with the main signals. Unfortunately, the circuitry needed to reduce the high noise levels may also reduce the accuracy of the circuits or systems to which the regulated supply voltages are applied. Low noise at high frequencies may be achieved with filtering by means of a load capacitor. To achieve the advantage of such filtering, the voltage regulator which provides the supply voltage must be slow, with bandwidth significantly below the signal band, e.g. 10 to 100 times lower than the signal band. At the same time, the regulated supply voltages for the above mentioned applications should be able to settle very rapidly to the required supply voltage value during recovery from large, very rapid changes in the amount of load current demanded by such applications.

Fast settling of an LDO voltage regulator output signal requires use of a fast voltage feedback loop. Unfortunately, this is opposed to the above-mentioned noise filtering, and requires that the LDO voltage regulator have a large current-supplying capability e.g., roughly 10 to 100 times the nominal or quiescent current of the LDO voltage regulator, in order to quickly charge and/or discharge the capacitance of the user application or load to which the regulated voltage is applied.

Known fast LDO voltage regulators including 2 feedback loops can achieve load settling times which are limited mainly by the maximum output current capability of the LDO voltage regulators. Multiple current gain boost paths are provided in a single gain stage in such known fast LDO voltage regulators. Prior Art FIG. 1 shows such an LDO voltage regulator 10-1 which can provide very fast-response load voltage regulation, with fast reaction times in response to step changes in the amount of current demanded by a load (e.g., a load such as integrated digital logic circuitry or a capacitive touch sensor to which the regulated voltage is applied) without substantially increasing the power consumption of the LDO voltage regulator, and without the need to use a large external load bypass capacitor. The fast LDO voltage regulator of Prior Art FIG. 1 is similar to the fast LDO voltage regulator shown in FIG. 2 of commonly assigned U.S. Pat. No. 7,633,280 entitled "Low Drop Voltage Regulator with Instant Load Regulation and Method" issued to Ivanov et al. Dec. 15, 2009.

Prior Art FIG. 1 shows a high-speed, low-power LDO voltage regulator 10-1 including an input stage having differentially coupled N-channel input transistors M0 and M1, P-channel active load transistors M2 and M3, and tail current source 4. LDO voltage regulator 10-1 also includes an output stage including P-channel pass transistor M7, N-channel pull-down transistor M5, N-channel cascode transistor M6, and a voltage source 11 which produces a constant bias voltage V0 on the gate of cascode transistor M6. A gain stage is coupled between the differential input stage and the output stage, and includes P-channel source follower transistor M4 and resistor R5.

The sources of input transistors M0 and M1 are connected to tail current source 4. The gate of input transistor M0 is connected to reference voltage Vref, and the gate of input transistor M1 is connected by conductor 5 to the junction between resistors R1 and R2. The sources of load transistors M2 and M3 and source follower transistor M4 are connected to regulated output voltage conductor 6 on which the regulated output voltage Vout is produced. The drains of input transistors M0 and M1 are connected by conductors 2 and 3 to the drains of active load transistors M2 and M3, respectively. The gates of load transistors M2 and M3 are connected to conductor 2 and their sources are connected to output conductor 8. Resistor R1 is connected between output conductor 8 and conductor 5, which is connected to the gate of input transistor M1, and resistor R2 is connected between conductor 5 and $V_{SS}$ so that resistors R1 and R2 form a voltage divider. The gate of source follower transistor M4 is connected by conductor 3 to the drains of input transistor M1 and active load transistor M3, and also is connected to one terminal of compensation capacitor C0. The source of source follower transistor M4 is connected to Vout by output conductor 8.

Output conductor 8 also is connected to the drain of pass transistor M7, the source of which is connected to $V_{DD}$. Output conductor 8 also is connected to the drain of pull-down transistor M5, the source of which is connected to $V_{SS}$. A load circuit 16 modeled as a parallel connection of a load capacitor $C_L$ and a load current source $I_L$ are connected to output conductor 8. A load circuit 16 may demand a load current that undergoes very fast, large-magnitude transitions. The gate of pass transistor M7 is connected by conductor 9 to the drain of cascode transistor M6 and to one terminal of a pull-up resistor R7, the other terminal of which is connected to $V_{DD}$. The source of cascode transistor M6 is connected by conductor 6 to the gate of pull-down transistor M5. The gate of cascode transistor M6 is connected by conductor 18 to receive a bias voltage V0 on the (+) terminal of voltage source 11, the (−) terminal of which is connected to $V_{SS}$. The drain of source follower transistor M4 is connected by conductor 6 to one terminal of resistor R5, the other terminal of which is connected to $V_{SS}$.

LDO voltage regulator 10-1 of Prior Art FIG. 1 includes three feedback loops. A first "accuracy" feedback loop includes input transistors M0 and M1 and source follower transistor M4. A second feedback loop includes common-gate source follower transistor M4, pull-down transistor M5, cascode transistor M6, and pass transistor M7. A third feedback loop includes source follower transistor M4, resistor R5, cascode transistor M6, and pass transistor M7. Internal capacitor C0 provides compensation for the first feedback loop. Capacitor C0 also decreases the bandwidth of the "accuracy" feedback loop including transistors M0 and M1 and source follower transistor M4, thereby decreasing the overall peak-to-peak noise at the output of voltage regulator 10-1.

The constant bias voltage V0 on conductor 18 causes the current in cascode transistor M6 to be substantially increased as the voltage on conductor 8 is decreased enough to turn pull-down transistor M5 off, so as to maintain a minimum current in pull-down transistor M5. In LDO voltage regulator 10-1, accuracy is determined by the "slow" loop including transistors M0, M1 and M4. The bandwidth gm0/C0 (where "gm0" is the transconductance of transistor M0) and high-frequency settling is determined by the two "fast" loops including transistors M4 and M5 and M4, M6, and M7, respectively.

During a large step increase of the current demanded by the load 16, a large amount of current must be supplied by pass transistor M7. That requires the gate voltage of pass transistor M7 to rapidly decrease. But pass transistor M7 is very large and has a large gate capacitance, so a large amount of current must be rapidly drawn out of the large gate capacitance of pass transistor M7 so it can supply the large step increase in current demanded by load 16.

The large step increase in demanded load current causes the regulated output voltage Vout to rapidly decrease, and that decreases the current through source follower transistor MP4 and resistor R5. The decreased current through resistor R5 lowers the source voltage of cascode transistor M6 and causes it to turn on harder, thereby increasing its drain current and rapidly discharging the large gate capacitance of pass transistor M7 so as to rapidly turn it on and supply the step increase in the demanded load current.

If the load current demanded by load 16 undergoes a large step decrease, this causes Vout to rapidly increase because load 16 suddenly is not sinking the large current being supplied by pass transistor M7. Consequently, the source voltage of source follower transistor M4 increases, causing it to turn on harder. That causes the gate voltage of pull-down transistor M5 to rapidly increase, so pull-down transistor M5 immediately sinks the available charge from capacitance associated with output conductor 8, thereby allowing sufficient time for pass transistor M7 to decrease its drain current. The rate at which the amplified drain current produced by pass transistor M7 decreases is determined by its gate capacitance and the resistance of pull-up resistor R7. This is how voltage regulator 10-1 of Prior Art FIG. 1 responds very rapidly to a step decrease in the demanded load current from a large value to a small value.

However, regulator 10-1 does not have adequate high-frequency noise filtering based on load capacitance $C_L$, and therefore it requires high current (and hence high power) to adequately lower the noise. The high-frequency filtering using the load capacitor is not efficient because of the high speed of the fast loop including source follower transistor M4 and the gate capacitance of pull-down transistor M5. There are several reasons for that filtering inefficiency. In order to achieve the high-frequency noise filtering (without benefit of the present invention), one technique that can be used is to make the load capacitor $C_L$ very large, but this expedient makes it necessary that the size of pull-down transistor M5 also be very large. However, larger the size of pull-down transistor M5, the more high-frequency noise is likely to be injected into regulator 10-1 through its power supplies. This is likely to substantially increase the cost of the integrated circuit chip. The resistance of resistor R5 may be reduced in order increase the current through source follower transistor M4. It would be necessary to reduce the current through pull-up resistor R7 and make both pull-up transistor M7 and pull-down transistor M5 very large. (If the resistance of resistor R5 is reduced, then more current flows through source follower transistor M4 and cascode transistor M6. The current that flows through source follower transistor M4 comes from pull-up transistor M7. The current from pull-up transistor M7 is split between source follower transistor M4 and pull-down transistor M5 (apart from transistors M2 and M3, of course). Therefore, increasing current in source follower transistor M4 means less current flows through cascode transistor M5. This increases the "on" resistance of pull-down transistor M5, which is undesirable. Since the current in cascode transistor M6 increases when the resistance R5 increases, that means the gate voltage of pull-up transistor M7 increases. Since it is a P channel transistor, the VGS voltage (gate-to-source voltage) of pull-up transistor M7 decreases, which means less current flows through pull-up transistor M7. Therefore, a reduction in the resistance R5 must be accompanied by a reduction in the resistance R7 to allow for more current through pull-down transistor M5.)

Unfortunately, due to the high speed of the fast loop (with bandwidth gm4/Cg5, where gm4 is the transconductance of source follower transistor M4 and Cg5 is the gate capacitance of pull-down transistor M5), the high-frequency filtering involving the load capacitor $C_L$ is not efficient, and high quiescent current is required in transistor M4 in order to adequately decrease high-frequency noise.

Thus, there is an unmet need for a voltage regulator and method which provide the combination of low noise at medium and high frequencies, very fast settling of the regulated output voltage, and low power consumption.

There also is an unmet need for a low-cost voltage regulator and method which provide the combination of low noise at medium and high frequencies, very fast settling of the regulated output voltage, and low power consumption.

There also is an unmet need for a voltage regulator and method which provide the combination of low noise at medium and high frequencies, very fast settling of the regulated output voltage, and low power consumption without use of an external resistor to accomplish filtering of high frequency noise from the regulated output voltage.

SUMMARY OF THE INVENTION

It is an object of the invention to provide a voltage regulator and method which provide the combination of low noise at medium and high frequencies, very fast settling of the regulated output voltage, and low power consumption.

It is another object of the invention to provide a low-cost voltage regulator and method which provide the combination of low noise at medium and high frequencies, very fast settling of the regulated output voltage, and low power consumption.

It is another object of the invention to provide a voltage regulator and method which provide the combination of low noise at medium and high frequencies, very fast settling of the regulated output voltage, and lo form a w power consumption without use of an external resistor to accomplish filtering of high frequency noise from the regulated output voltage.

Briefly described, and in accordance with one embodiment, the present invention provides a voltage regulator that controls a regulated output voltage (Vout) by feeding it back to a differential input stage (13) receiving a reference voltage (Vref) and applying an output (3) to a control electrode of a follower transistor (M4) that is coupled to an output stage (15) which generates the output voltage (Vout). The output stage operates pull-up (M7B) and pull-down (M5B) transistors in response to a signal (6A) produced by the follower transistor (M4) during normal regulation operation, and provides fast settling of the output voltage by turning on a transient pull-up transistor (M7A) or transient pull-down transistor (M5A) in response to the signal (6A) produced by the follower transistor (M4) during a fast increasing or decreasing transition, respectively, of the load current ($I_L$). A filtering resistor ($R_{FLT}$) is coupled between the output voltage and a common electrode of the transient pull-up and pull down transistors.

In one embodiment, the invention provides Voltage regulator circuitry (10-2) including a differential input stage (13) having a first input (1) coupled to receive a reference voltage (Vref), a second input (5) coupled to a regulated output conductor (8) of the voltage regulator circuitry (10-2), and an output (3). An output stage (15) for producing a regulated output voltage (Vout) on the regulated output conductor (8) includes a transient pull-up transistor (M7A) having a first electrode coupled to a first supply voltage ($V_{DD}$) and a second electrode coupled to the regulated output conductor (8) and a transient pull-down transistor (M5A) having a first electrode coupled to a second supply voltage ($V_{SS}$) and a second electrode coupled to the regulated output conductor (8). The output stage also includes a primary pull-up transistor (M7B) having a first electrode coupled to the first supply voltage ($V_{DD}$) and a second electrode coupled to the regulated output conductor (8) and a primary pull-down transistor (M5B) having a first electrode coupled to the second supply voltage ($V_{SS}$) and a second electrode coupled to the regulated output conductor (8). In one embodiment, the output stage also includes a filtering resistor ($R_{FLT}$) coupled between the regulated output conductor (8) and the second electrodes (14) of the primary pull-up transistor (M7B) and the primary pull-down transistor (M5B). A gain stage (M4,M6,R5A,R5B) includes a cascode transistor (M6) having a first electrode coupled to control electrodes of the primary pull-down transistor (M5B) and the transient pull-down transistor (M5A) and a second electrode coupled to the control electrodes of the primary pull-up transistor (M7B) and the transient pull-up transistor (M7A). The gain stage also includes a follower transistor (M4) having a first electrode coupled to the regulated output conductor (8), a control electrode coupled to the output (3) of the differential input stage (13), and a second electrode coupled to the first electrode of the cascode transistor (M6) and the control electrodes of the primary pull-down transistor (M5B) and the transient pull-down transistor (M5A).

In one embodiment, the filtering resistor ($R_{FLT}$) operates in conjunction with a load capacitance ($C_L$) to filter noise from the regulated output voltage (Vout).

In one embodiment, the differential input stage (13), output stage (15), and gain stage (M4,M6,R5A,R5B) operate to regulate the output voltage (Vout) to a predetermined value having a predetermined relationship to the regulated output voltage (Vout) by controlling the primary pull-up transistor (M7B) and the primary pull-down transistor (M7A) during normal voltage regulating operation, and also operate to turn on the transient pull-up transistor (M7A) or the transient pull-down transistor (N5A) in response to a sufficiently large, fast transition of a load current ($I_L$) flowing in the regulated output conductor (8), depending on the direction of the transition of the load current ($I_L$), so as to cause rapid settling of the regulated output voltage (Vout) back to the predetermined value.

In one embodiment, the transistors are MOS (metal-oxide-semiconductor) transistors, the first electrodes are sources, the second electrodes are drains, and the control electrodes are gates. In one embodiment, the transient pull-up transistor (M7A), the primary pull-up transistor (M7B) and the source follower transistor (M4) are P-channel transistors, and the transient pull-down transistor (M5A), the primary pull-down transistor (M5B) and the cascode transistor (M6) are N-channel transistors.

In one embodiment, the input stage (13) includes a first input transistor (M0) having a source connected to a tail current source (4), a gate coupled to receive the reference voltage (Vref), and a drain coupled to a gate and a drain of a first load transistor (M2) and a gate of a second load transistor (M3), and also includes a second input transistor (M1) having a source coupled to the tail current source (4), a gate coupled to the regulated output voltage conductor (8), and a drain coupled to a drain of the second load transistor (M3) and to the output (3) of the differential input stage (13).

In one embodiment, the gate of the second input transistor (M1) is coupled to the regulated output conductor (8) by means of a resistive divider circuit (R1,R2).

In one embodiment, sources of the first (M2) and second (M3) load transistors are coupled to the regulated output voltage (Vout).

In one embodiment, the filtering resistor ($R_{FLT}$) is integrated on an integrated circuit chip with the voltage regulator circuitry (10-2).

In one embodiment, a channel resistance of the transient pull-up transistor (M7A) during a first-direction transition of the load current ($I_L$) is lower than a channel resistance of the primary pull-up transistor (M7B) and a channel resistance of the transient pull-down transistor (M5A) during a second-direction transition of the load current ($I_L$) is lower than a channel resistance of the primary pull-down transistor (M5B).

In one embodiment, the predetermined relationship is represented by a predetermined ratio of the output voltage (Vout) to the reference voltage (Vref).

In one embodiment, the gain stage (M4,M6,R5A,R5B) includes a voltage source (11) for producing a constant bias voltage (V0) on a control electrode of the cascode transistor (M6).

In one embodiment, a compensation capacitor (CO) is coupled between the output (3) of the differential input stage (13) and the second supply voltage ($V_{SS}$).

In one embodiment, the load capacitance ($C_L$) is integrated on an integrated circuit chip with the voltage regulator circuitry (10-2) and is coupled to the regulated output conductor (8) and wherein a load (16) coupled to the regulated output conductor (8) demands a step change in current supplied by the voltage regulator circuitry (10-2) to the load.

In one embodiment, the invention provides a method for producing fast settling of a regulated output voltage (Vout), the method including controlling the accuracy of the regulated output voltage (Vout) produced by a voltage regulator (10-2) by feeding back the regulated output voltage (Vout) to an input (5) of a differential input stage (13) having a reference voltage (Vref) applied to a reference input (1) of the differential input stage (13) and applying an output (3) of the differential input stage (13) to a control electrode of a follower transistor (M4) having a first electrode coupled to an output stage (15) which generates the regulated output voltage (Vout) on a regulated output conductor (8), and controlling a primary pull-up transistor (M7B) and a primary pull-down transistor (M5B) of the output stage (15), each coupled to the regulated output conductor (8), in response to a signal (6A) produced on a second electrode of the follower transistor (M4) during normal regulation operation of the voltage regulator (10-2) to maintain a predetermined level of the regulated output voltage (Vout); and providing fast settling of the regulated output voltage (Vout) by turning on a transient pull-up transistor (M7A) disposed in the output stage (15) and coupled to the regulated output conductor (8), in response to a signal (6A) produced on the second electrode of the follower transistor (M4) during a fast increasing transition of the load current ($I_L$), and turning on a transient pull-down transistor (M5A) disposed in the output stage (15) and coupled to the regulated output conductor (8), in response to a signal (6A) produced on the second electrode of the follower transistor (M4) during a fast decreasing transition of the load current ($I_L$).

In one embodiment, the method includes providing the transistors as MOS (metal-oxide-semiconductor) transistors, wherein the first electrodes are sources, the second electrodes are drains, and the control electrodes are gates, the method including coupling a first terminal of a filtering resistor ($R_{FLT}$) to drains of the primary pull-up transistor (M7B) and primary pull-down transistor (M5B) and coupling a second terminal of the filtering resistor ($R_{FLT}$) to drains of the transient pull-up transistor (M7A) and transient pull-down transistor (M5A) to filter noise from the regulated output voltage (Vout).

In one embodiment, the method includes supplying a rapidly increased amount of load current ($I_L$) during a fast transition to an increased amount of load current ($I_L$) demanded by the load (16) by applying the regulated output voltage (Vout) to the source of the follower transistor (M4) to cause the drain of the follower transistor to rapidly turn a cascode transistor (M6) on harder, and causing a drain of the cascode transistor (M6) to turn on the transient pull-up transistor (M7A) in response to an increasing drain current produced by the cascode transistor (M6).

In one embodiment, the method includes sinking a rapidly increased amount of load current ($I_L$) during a fast transition to a decreased amount of load current ($I_L$) demanded by the load (16) by applying the regulated output voltage (Vout) to the source of the follower transistor (M4) to cause the drain of the follower transistor to rapidly turn on the transient pull-down transistor (M5A).

In one embodiment, the invention provides a voltage regulator (10-2) for producing a fast settling regulated output voltage (Vout), including circuitry for controlling the accuracy of the regulated output voltage (Vout) produced by a voltage regulator (10-2), including means (R1,R2) for feeding back the regulated output voltage (Vout) to an input (5) of a differential input stage (13) having a reference voltage (Vref) applied to a reference input (1) of the differential input stage (13), means (3) for applying an output of the differential input stage (13) to a control electrode of a follower transistor (M4) having a first electrode coupled to an output stage (15) which generates the regulated output voltage (Vout) on a regulated output conductor (8), and means (M6,R7B,R5B) for controlling a primary pull-up transistor (M7B) and a primary pull-down transistor (M5B) of the output stage (15), each coupled to the regulated output conductor (8), in response to a signal (6A) produced on a second electrode of the follower transistor (M4) during normal regulation operation of the voltage regulator (10-2) to maintain a predetermined level of the regulated output voltage (Vout); and circuitry for providing fast settling of the regulated output voltage (Vout), including means (M6,R7B,R7A) for turning on a transient pull-up transistor (M7A) disposed in the output stage (15) and coupled to the regulated output conductor (8), in response to a signal (6A) produced on the second electrode of the follower transistor (M4) during a fast increasing transition of the load current ($I_L$), and means (M6,R5B,R5A) for turning on a transient pull-down transistor (M5A) disposed in the output stage (15) and coupled to the regulated output conductor (8), in response to a signal (6A) produced on the second electrode of the follower transistor (M4) during a fast decreasing transition of the load current ($I_L$).

DETAILED DESCRIPTION OF THE PREFERRED EMBODIMENTS

Figure 2:
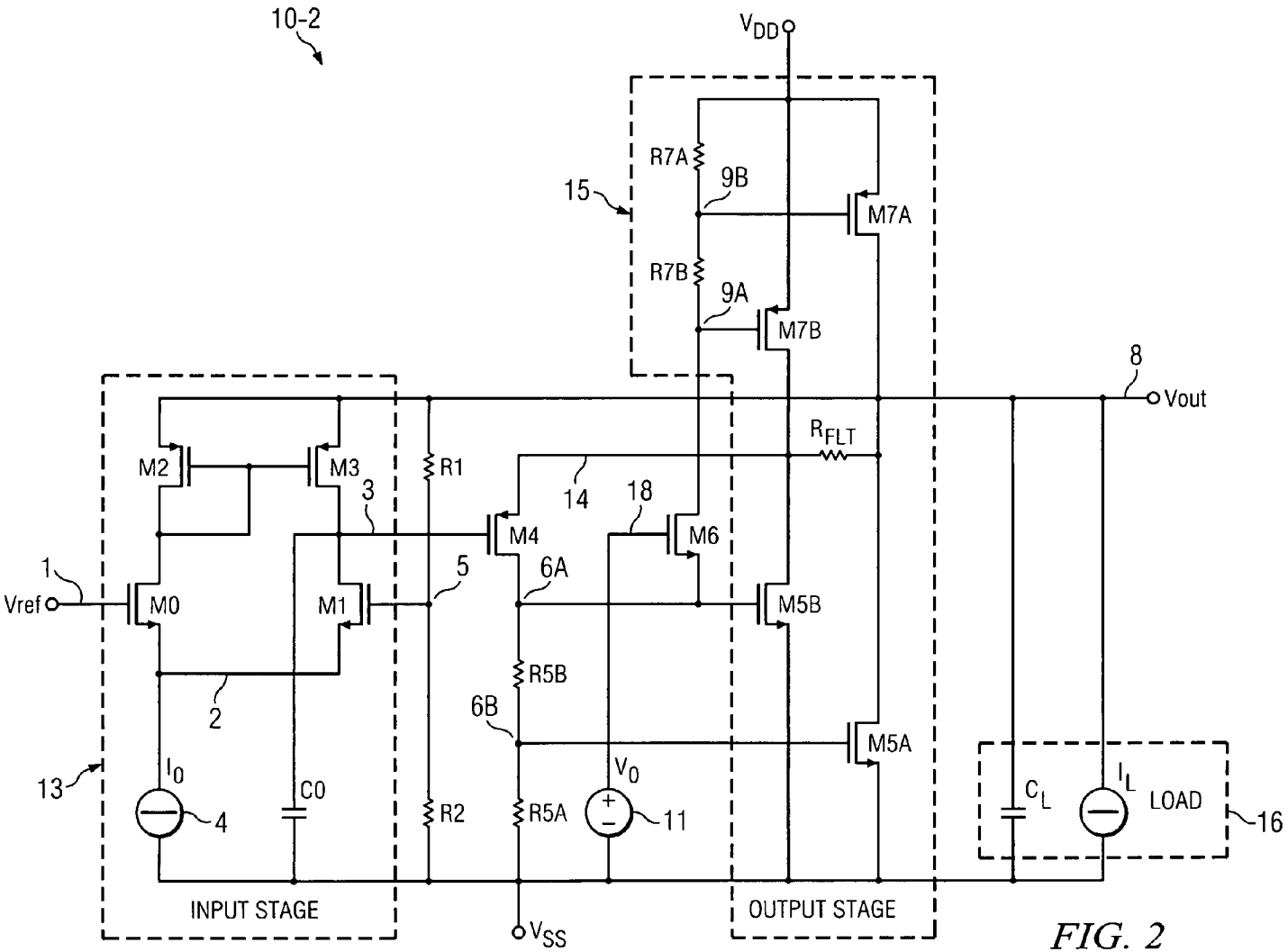
FIG. 2 is a schematic diagram of a low noise, fast settling, low power LDO voltage regulator which is a preferred embodiment of the invention.

High-speed, low-power LDO voltage regulator 10-2 in FIG. 2 includes an input stage 13 including differentially coupled N-channel input transistors M0 and M1, P-channel active load transistors M2 and M3, and a tail current source 4. LDO voltage regulator 10-1 also includes an output stage 15 including a P-channel "transient pull-up" transistor M7A, a N-channel "transient pull-down" transistor M5A, a P-channel "transient pull-up" transistor M7B, a "primary pull-down" transistor M5B, pull-up resistors R7A and R7B, and a filtering resistor $R_{FLT}$. A gain stage is coupled between input stage 13 and output stage 15, and includes a P-channel source follower transistor M4, pull-down resistors R5A and R5B, a cascode transistor M6 and a voltage reference 11.

The sources of input transistors M0 and M1 are connected to tail current source 4. The gate of input transistor M0 is connected to an input or reference voltage Vref. Resistors R1 and R2 are connected in series between Vout and $V_{SS}$. The gate of input transistor M1 is connected by conductor 5 to the junction between resistors R1 and R2, which form a voltage divider that operates to feed back a predetermined proportion of Vout to the gate of input transistor M1. (Of course, Vout could be coupled directly to the gate of input transistor M1.) The sources of active load transistors M2 and M3 and source follower transistor M4 are connected to Vout on conductor 8. The drains of input transistors M0 and M1 are connected to the drains of active load transistors M2 and M3, respectively. The drain of input transistor M1 also is connected by conductor 3 to a compensation capacitor C0. The gates of load transistors M2 and M3 are connected to the drain of input transistor M0. (However, the sources of load transistors M2 and M3 could be connected to $V_{DD}$ instead of output conductor 8. Also, there are numerous other implementations of input stage 13 which could provide satisfactory performance.)

Output conductor 8 is connected to the drain of transient pull-up transistor M7A, the source of which is connected to $V_{DD}$. Output conductor 8 also is connected to the drain of transient pull-down transistor M5A, the source of which is connected to $V_{SS}$. Output conductor 8 also is connected to a load circuit 16 which is modeled as a parallel connection of a load capacitor $C_L$ and a load current source $I_L$. Load capacitor $C_L$ may be integrated on the same integrated circuit die along with LDO voltage regulator 10-2. The current demanded by load 16 may undergo very fast (e.g., between 0 and tens of microseconds), large-magnitude (e.g., 0 to 1-2 amperes) transitions.

The gate of transient pull-up transistor M7A is connected by conductor 9B to one terminal of pull-up resistor R7B. the other terminal of pull-up resistor R7B M6. Pull-up resistor R7A is coupled between conductor 9B and $V_{DD}$. The gate of cascode transistor M6 is connected by conductor 18 to receive the bias voltage V0 on the (+) terminal of voltage source 11, the (−) terminal of which is connected to $V_{SS}$.

The source of primary pull-up transistor M7B is connected to $V_{DD}$. The drain of primary pull-up transistor M7B is connected by conductor 14 to the source of source follower transistor M4. The source electrode of source follower transistor M4 is connected by conductor 14 to the drains of primary pull-up transistor M7B and primary pull-down transistor M5B and to one terminal of filtering resistor $R_{FLT}$, the other terminal of which is connected by Vout conductor 8 to the drains of transient pull-up transistor M7A and transient pull-down transistor M5A. The gate of source follower transistor M4 is connected to conductor 3.

The gate of primary pull-down transistor M5B is connected by conductor 6A to the source of cascode transistor M6, the drain of source follower transistor M4, and one terminal of resistor R5B. The other terminal of pull-down resistor R5B is connected by conductor 6B to the gate of transient pull-down transistor M5A and one terminal of resistor R5A, the other terminal of which is connected to $V_{SS}$.

In operation, if load 16 suddenly demands a large increase in load current $I_L$, that pulls Vout lower. The resistive divider R1,R2 therefore lowers the gate voltage of input transistor Ml. Therefore, less of the tail current I0 flows through input transistor M1, and more flows through input transistor M0 and current mirror input (active load) transistor M2 and therefore is mirrored through current mirror output (active load) transistor M3. This increase in the current through active load transistor M3 increases the gate voltage of source follower transistor M4. This in turn reduces the current through source follower transistor M4, thereby decreasing the voltage developed across pull-down resistors R5B and R5A and therefore decreases the voltage on conductor 6A and the source of cascode transistor M6. This causes cascode transistor M6 to rapidly increase the amount of current through pull-up resistors R7A and R7B, to a sufficiently high level to turn transient pull-up transistor M7A on hard. This causes transient pull-up transistor M7A to rapidly supply the sharply increased amount of current being demanded by load 16, thereby providing fast settling of regulator 10-2 back to a level close to the proportion of Vref determined by the voltage divider R1,R2. (The decreased voltage on conductor 6A also results in reduced current through primary pull-down transistor M5B and keeps transient pull-down transistor M5A off.) At that point, the feedback through input stage 13 and the gain stage (including source follower transistor M4 and cascode transistor M6) causes regulator 10-2 to resume normal regulation of Vout by means of primary pull-up transistor M7B, primary pull-down transistor M5B, and filtering resistor $R_{FLT}$.

Essentially the opposite operation occurs if the current demanded by load 16 suddenly decreases. That is, if the amount of load current $I_L$ demanded by load 16 suddenly decreases by a large amount, the amount of current being supplied to load 16 by primary pull-up transistor M7B causes Vout to rapidly increase. This causes resistive divider R1,R2 to increase the gate voltage of input transistor M1. Therefore, more of tail current I0 flows through input transistor M1, and therefore less tail current flows through input transistor M0, current mirror input (active load) transistor M2, and current mirror output (active load) transistor M3. The decrease in the current through active load transistor M3 decreases the gate voltage of source follower transistor M4, which in turn increases the current through source follower transistor M4. That increases the voltage developed across pull-down resistors R5B and R5A and increases the voltages on conductors 6A and 6B. The resulting increased voltage on the gate of transient pull-down transistor M5A causes it to turn on hard and rapidly pull Vout back to a level close to the proportion of Vref determined by voltage divider R1,R2. (The resulting increased voltage on conductor 6A also causes cascode transistor M6 to sharply decrease the amount of current through pull-up resistors R7A and R7B to thereby turn transient pull-up transistor M7A off and reduce the amount of current through primary pull-up transistor M7B.) At that point, the feedback through input stage 13 and the gain stage (including source follower transistor M4 and cascode transistor M6) causes regulator 10-2 to resume normal regulation of Vout by means of primary pull-up transistor M7B, primary pull-down transistor M5B, and filtering resistor $R_{FLT}$.

Figure 1:
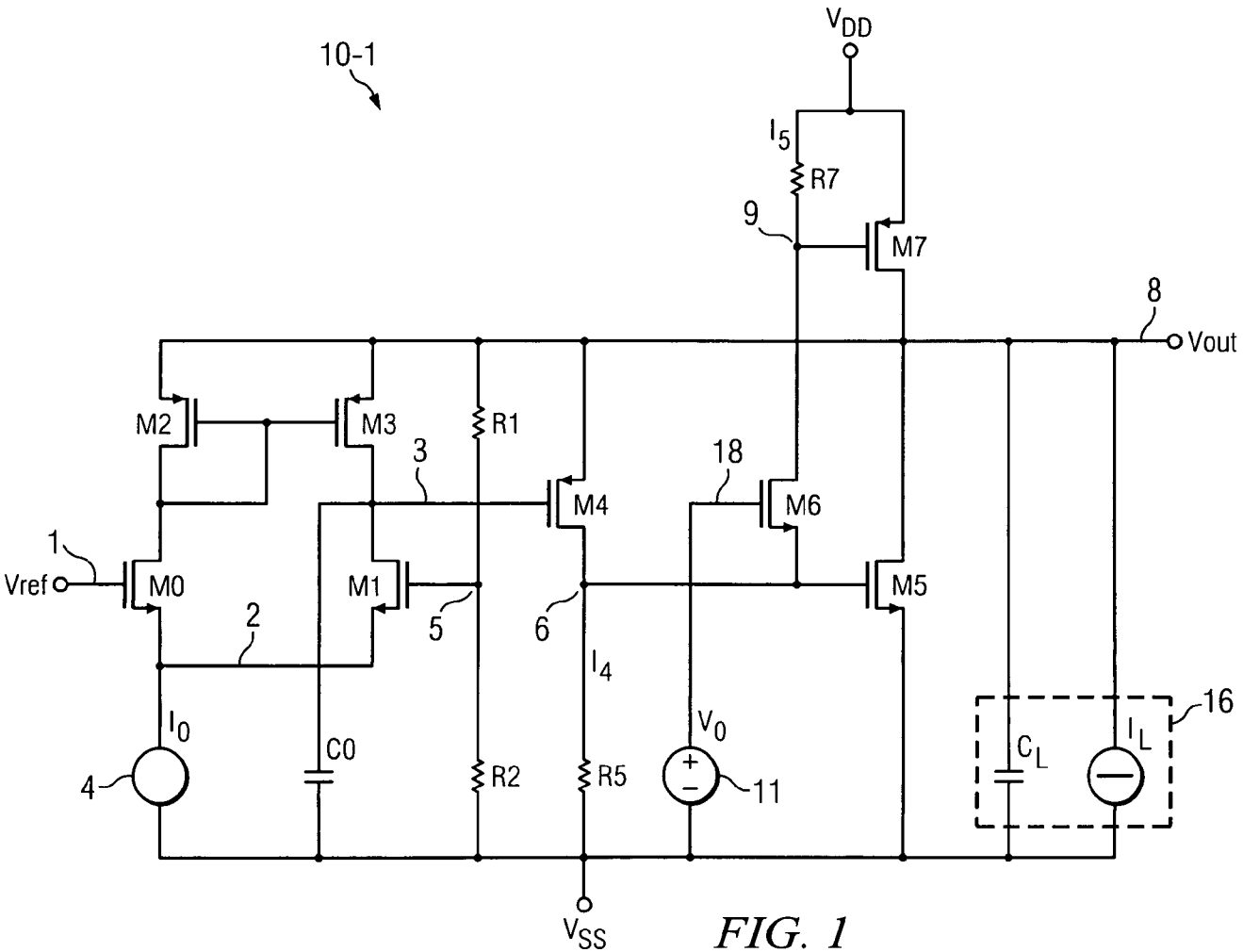
FIG. 1 (PRIOR ART)
FIG. 1 is a schematic diagram of a prior art fast-settling LDO voltage regulator.

Low-resistance (e.g., 5 to 100 ohms) filtering resistor $R_{FLT}$ is connected to the previously mentioned slow loop including primary pull-up and pull down transistors M7B and M5B, between the slow loop and the fast loop including transistors M7A and M5A. This substantially improves the high-frequency filtering that is based on load capacitance $C_L$ and reduces the high-frequency noise in the regulated output voltage Vout. Also, providing the resistance of filtering resistor $R_{FLT}$ helps stabilize the main loop from input to output (including transistors M0, M1 and M4), and also the above-mentioned fast loop including transistors M7A and M5A, in addition to reducing the high-frequency noise. Furthermore, providing filtering resistor $R_{FLT}$ in the main loop from input to output (including transistors M0, M1 and M4) and integrated on the same die as LDO voltage regulator 10-2 avoids the need for the user to provide a costly external resistor to reduce the high-frequency noise that would be required by the fast-settling voltage regulator 10-1 of Prior Art FIG. 1.

Transient pull-up transistor M7A and transient pull-down transistor M5A are off during normal operation and therefore do not affect Vout during that time. During transient operation, transient pull-up transistor M7A and transient pull-down transistor M5A act as resistors M5B or M7B because they are trioding at these moments due to the larger current through $R_{FLT}$. Transient pull-up transistor M7A and transient pull-down transistor M5A are actually slightly larger than primary pull-up transistor M7B and primary pull-down transistor M5B, respectively, so transient pull-up transistor M7A and transient pull-down transistor M5A actually are turned on somewhat harder, and they essentially overcome or overpower the high channel resistances of primary transient pull-up transistor M7B and primary transient pull-down transistor M5B, respectively.

LDO voltage regulator 10-2 of FIG. 2 dramatically improves the response time and settling of large, extremely fast loop current transients while also providing low levels of high-frequency noise in Vout without incurring substantial additional cost. This is accomplished by the combination of multiple feedback loops with different speeds and nonlinear transitions from one loop to another and by use of nonlinear signal filtering in the multiloop system in order to achieve both the fast settling and the low mid-and high frequency noise levels in the regulated output voltage signal. Furthermore, the very fast regulated output voltage settling times and low noise levels are achieved at very low current and power consumption levels.

Transient pull-down transistor M5A and transient pull-up transistor M7A are OFF at small load current levels, and load 16 is "separated" from the "fast" loops (the loop including transistor M4, resistor R5B, and transistor M5A and the loop including transistors M4 and M6, resistor R7B, and transistor M7A) by resistor $R_{FLT}$. High-frequency noise is filtered by filtering circuitry having the time constant $R_{FLT}C_L$. The voltage drop across filtering resistor $R_{FLT}$ is small, e.g., below approximately 50-100 millivolts. $R_{FLT}$ helps filter out noise at medium and high frequencies, and should be included inside the above-mentioned fast loops because then it can be integrated inside the integrated circuit die. (Filtering resistor $R_{FLT}$ will cause a DC shift in the output voltage as compare to the ideal expected output voltage (the 50-100 millivolts mentioned in the previous sentence), so if the resistance $R_{FLT}$ is too large, then the proper DC regulation is not maintained.) In this circuit, low-frequency accuracy is defined by the "slow" main loop including transistors M0, M1, and M4 that accomplishes the DC regulation. The loop current, when the dominant operation occurring in output stage 15 is transferred from primary pull-down transistor M5B to transient pull-down transistor M5A or from primary pull-up transistor M7B to transient pull-up transistor M7A, is determined by voltage drop across primary pull-down resistor R5B or primary pull-up resistor R7B, respectively. Also, filtering resistor $R_{FLT}$ has the advantage of improving the stability of the fast loop including transistor M4, resistor R5B, and transistor M5A and the loop including transistors M4 and M6, resistor R7B, and transistor M7A.

While the invention has been described with reference to several particular embodiments thereof, those skilled in the art will be able to make various modifications to the described embodiments of the invention without departing from its true spirit and scope. It is intended that all elements or steps which are insubstantially different from those recited in the claims but perform substantially the same functions, respectively, in substantially the same way to achieve the same result as what is claimed are within the scope of the invention. For example, some of the components could be replaced with bipolar transistors. A somewhat different input stage could be used, such as a current mirror operational amplifier or a folded cascode operational amplifier. Also, one or more of resistors R5A, R5B, R7A and R7B could be replaced by current sources. A combination of current sources and R5A, R5B, R7A and R7B might also be employed to find a desired balance between speed and stability. The gate of cascode transistor M6 could be biased by something other than a voltage source.

What is claimed is:

1. Voltage regulator circuitry comprising:

(a) a differential input stage including a first input coupled to receive a reference voltage, a second input coupled to a regulated output conductor of the voltage regulator circuitry, and an output;

(b) an output stage for producing a regulated output voltage on the regulated output conductor, including 1) a transient pull-up transistor having a first electrode coupled to a first supply voltage and a second electrode coupled to the regulated output conductor, a transient pull-down transistor having a first electrode coupled to a second supply voltage and a second electrode coupled to the regulated output conductor, 2) a primary pull-up transistor having a first electrode coupled to the first supply voltage and a second electrode coupled to the regulated output conductor, a primary pull-down transistor having a first electrode coupled to the second supply voltage and a second electrode coupled to the regulated output conductor, and 3) a filtering resistor coupled between the regulated output conductor and the second electrodes of the primary pull-up transistor and the primary pull-down transistor; and (c) a gain stage including 1) a cascode transistor having a first electrode coupled to control electrodes of the primary pull-down transistor and the transient pull-down transistor and a second electrode coupled to control electrodes of the primary pull-up transistor and the transient pull-up transistor, and 2) a follower transistor having a first electrode coupled to the regulated output conductor, a control electrode coupled to the output of the differential input stage, and a second electrode coupled to the first electrode of the cascode transistor and the control electrodes of the primary pull-down transistor and the transient pull-down transistor, wherein the differential input stage, output stage, and gain stage operate to 1) regulate the output voltage to a predetermined value having a predetermined relationship to the regulated output voltage by controlling the primary pull-up transistor and the primary pull-down transistor during normal voltage regulating operation, and 2) turn on the transient pull-up transistor or the transient pull-down transistor in response to a sufficiently large, fast transition of a load current flowing in the regulated output conductor, depending on the direction of the transition of the load current, so as to cause rapid settling of the regulated output voltage back to the predetermined value.

2. The voltage regulator circuitry of claim 1 wherein the filtering resistor operates in conjunction with a load capacitance to filter noise from the regulated output voltage.

3. The voltage regulator circuitry of claim 1 wherein the transistors are MOS (metal-oxide-semiconductor) transistors, the first electrodes are sources, the second electrodes are drains, and the control electrodes are gates.

4. The voltage regulator circuitry of claim 3 wherein the transient pull-up transistor, the primary pull-up transistor and the source follower transistor are P-channel transistors, and wherein the transient pull-down transistor, the primary pull-down transistor and the cascode transistor are N-channel transistors.

5. The voltage regulator circuitry of claim 1 wherein the input stage includes a first input transistor having a source connected to a tail current source, a gate coupled to receive the reference voltage, and a drain coupled to a gate and a drain of a first load transistor and a gate of a second load transistor, and also includes a second input transistor having a source coupled to the tail current source, a gate coupled to the regulated output voltage conductor, and a drain coupled to a drain of the second load transistor and to the output of the differential input stage.

6. The voltage regulator circuitry of claim 5 wherein the gate of the second input transistor is coupled to the regulated output conductor by means of a resistive divider circuit.

7. The voltage regulator circuitry of claim 5 wherein sources of the first and second load transistors are coupled to the regulated output voltage.

8. The voltage regulator circuitry of claim 2 wherein the filtering resistor is integrated on an integrated circuit chip with the voltage regulator circuitry.

9. The voltage regulator circuitry of claim 1 wherein during a first-direction transition of the load current a channel resistance of the transient pull-up transistor is lower than a channel resistance of the primary pull-up transistor and wherein during a second-direction transition of the load current a channel resistance of the transient pull-down transistor is lower than a channel resistance of the primary pull-down transistor.

10. The voltage regulator circuitry of claim 1 wherein the predetermined relationship is represented by a predetermined ratio of the output voltage to the reference voltage.

11. The voltage regulator circuitry of claim 1 wherein the gain stage includes a voltage source for producing a constant bias voltage on a control electrode of the cascode transistor.

12. The voltage regulator circuitry of claim 5 including a compensation capacitor coupled between the output of the differential input stage and the second supply voltage.

13. The voltage regulator circuitry of claim 2 wherein the load capacitance is integrated on an integrated circuit chip with the voltage regulator circuitry and is coupled to the regulated output conductor and wherein a load coupled to the regulated output conductor demands a step change in current supplied by the voltage regulator circuitry to the load.

14. A method for producing fast settling of a regulated output voltage produced by a voltage regulator, the method comprising:

(a) controlling the accuracy of the regulated output voltage by 1) feeding back the regulated output voltage to an input of a differential input stage having a reference voltage applied to a reference input of the differential input stage and applying an output of the differential input stage to a control electrode of a follower transistor having a first electrode coupled to an output of an output stage which generates the regulated output voltage on a regulated output conductor, and 2) controlling a primary pull-up transistor and a primary pull-down transistor of the output stage, each coupled to the regulated output conductor, in response to a signal produced on a second electrode of the follower transistor during normal regulation operation of the voltage regulator to maintain a predetermined level of the regulated output voltage; and (b) providing fast settling of the regulated output voltage by 1) turning on a transient pull-up transistor disposed in the output stage and coupled to the regulated output conductor, in response to a signal produced on the second electrode of the follower transistor during a fast increasing transition of the load current, and 2) turning on a transient pull-down transistor disposed in the output stage and coupled to the regulated output conductor, in response to a signal produced on the second electrode of the follower transistor during a fast decreasing transition of the load current wherein the differential input stage, output stage, and gain stage operate to 1) regulate the output voltage to a predetermined value having a predetermined relationship to the regulated output voltage by controlling the primary pull-up transistor and the primary pull-down transistor during normal voltage regulating operation, and 2) turn on the transient pull-up transistor or the transient pull-down transistor in response to a sufficiently large, fast transition of a load current flowing in the regulated output conductor, depending on the direction of the transition of the load current, so as to cause rapid settling of the regulated output voltage back to the predetermined value.

15. The method of claim 14 including providing the transistors as MOS (metal-oxide-semiconductor) transistors, wherein the first electrodes are sources, the second electrodes are drains, and the control electrodes are gates, the method including coupling a first terminal of a filtering resistor to drains of the primary pull-up transistor and primary pull-down transistor and coupling a second terminal of the filtering resistor to drains of the transient pull-up transistor and transient pull-down transistor to filter noise from the regulated output voltage.

16. The method of claim 15 including supplying a rapidly increased amount of load current during a fast transition to an increased amount of load current demanded by a load by applying the regulated output voltage to the source of the follower transistor to cause the drain of the follower transistor to rapidly turn a cascode transistor on harder, and causing a drain of the cascode transistor to turn on the transient pull-up transistor in response to an increasing drain current produced by the cascode transistor.

17. The method of claim 15 including sinking a rapidly increased amount of load current load by applying the regulated output voltage to the source of the follower transistor to cause the drain of the follower transistor to rapidly turn on the transient pull-down transistor.

18. A voltage regulator for producing a fast settling regulated output voltage, comprising:

(a) circuitry for controlling the accuracy of the regulated output voltage produced by the voltage regulator, including 1) means for feeding back the regulated output voltage to an input of a differential input stage having a reference voltage applied to a reference input of the differential input stage, 2) means for applying an output of the differential input stage to a control electrode of a follower transistor having a first electrode coupled to an output of an output stage which generates the regulated output voltage on a regulated output conductor, and 3) means for controlling a primary pull-up transistor and a primary pull-down transistor of the output stage, each coupled to the regulated output conductor, in response to a signal produced on a second electrode of the follower transistor during normal regulation operation of the voltage regulator to maintain a predetermined level of the regulated output voltage; and (b) circuitry for providing fast settling of the regulated output voltage, including 1) means for turning on a transient pull-up transistor disposed in the output stage and coupled to the regulated output conductor, in response to a signal produced on the second electrode of the follower transistor during a fast increasing transition of the load current, and 2) means for turning on a transient pull-down transistor disposed in the output stage and coupled to the regulated output conductor, in response to a signal produced on the second electrode of the follower transistor during a fast decreasing transition of the load current, wherein the differential input stage, output stage, and gain stage operate to 1) regulate the output voltage to a predetermined value having a predetermined relationship to the regulated output voltage by controlling the primary pull-up transistor and the primary pull-down transistor during normal voltage regulating operation, and 2) turn on the transient pull-up transistor or the transient pull-down transistor in response to a sufficiently large, fast transition of a load current flowing in the regulated output conductor, depending on the direction of the transition of the load current, so as to cause rapid settling of the regulated output voltage back to the predetermined value.

* * * * *